US008387680B2

(12) United States Patent
Beyer-Steinhauer et al.

(10) Patent No.: US 8,387,680 B2
(45) Date of Patent: Mar. 5, 2013

(54) POSITION-CONTROLLED OR PRESSURE-CONTROLLED DEVICE FOR THE HYDRAULIC POSITIONING OF COMPONENTS

(75) Inventors: Holger Beyer-Steinhauer, Mettmann (DE); Peter Jonen, Duisburg (DE); Dietmar Hinz, Duisburg (DE); Lothar Schaps, Heinsberg (DE); Axel Weyer, Wuppertal (DE)

(73) Assignee: SMS Siemag AG, Dusseldorf (DE)

( * ) Notice: Subject to any disclaimer, the term of this patent is extended or adjusted under 35 U.S.C. 154(b) by 0 days.

(21) Appl. No.: 12/593,823

(22) PCT Filed: Feb. 5, 2008

(86) PCT No.: PCT/DE2008/000236

§ 371 (c)(1), (2), (4) Date: Feb. 2, 2010

(87) PCT Pub. No.: WO2008/119312

PCT Pub. Date: Oct. 9, 2008

(65) Prior Publication Data

US 2010/0132908 A1 Jun. 3, 2010

(30) Foreign Application Priority Data

Mar. 30, 2007 (DE) ..... 10 2007 016 045

(51) Int. Cl.
*B22D 11/20* (2006.01)
*B22D 11/128* (2006.01)

(52) U.S. Cl. ..... 164/413; 164/269

(58) Field of Classification Search ..... 164/413, 164/269, 454, 484, 441, 447
See application file for complete search history.

(56) References Cited

U.S. PATENT DOCUMENTS

| | | | | |
|---|---|---|---|---|
| 6,142,212 | A * | 11/2000 | Scholz et al. | 164/452 |
| 6,491,088 | B1 * | 12/2002 | Sucker et al. | 164/454 |
| 6,540,010 | B1 * | 4/2003 | Geerkens et al. | 164/413 |
| 2002/0157807 | A1 * | 10/2002 | Nikolovski et al. | 164/454 |
| 2003/0145976 | A1 * | 8/2003 | Von Wyl et al. | 164/459 |
| 2004/0003710 | A1 | 1/2004 | Pinot | |
| 2004/0026066 | A1 * | 2/2004 | Rahmfeld et al. | 164/452 |
| 2004/0122536 | A1 | 6/2004 | Saitou | |
| 2006/0037466 | A1 | 2/2006 | Yahima et al. | |

FOREIGN PATENT DOCUMENTS

| | | |
|---|---|---|
| DE | 102005031732 | 3/2006 |
| EP | 1414059 | 4/2004 |
| WO | WO 0009279 | 2/2000 |
| WO | WO 2004005728 | 1/2004 |
| WO | WO 2004020840 | 3/2004 |

* cited by examiner

*Primary Examiner* — Kevin P Kerns
(74) *Attorney, Agent, or Firm* — Cozen & O'Connor

(57) ABSTRACT

A device for the hydraulic positioning of structural component parts, in particular rollers of strand guide segments of a continuous casting installation, with hydraulic cylinders, each of which is divided into a cylinder space and an annular cylinder space by a piston having a piston rod. The cylinder spaces can be connected to a pressure source by of control members. Hydraulic connection lines are reduced or components used are reduced. Either the annular cylinder space is acted upon by a pressure which is adjustable but which then remains constant, while the pressure applied to the piston in the cylinder space is position-controlled or pressure-controlled, or the cylinder space is acted upon by a pressure which is adjustable but which then remains constant, while the pressure applied to the piston in the annular cylinder space is position-controlled or pressure-controlled.

17 Claims, 4 Drawing Sheets

POSITION-CONTROLLED OR PRESSURE-CONTROLLED DEVICE FOR THE HYDRAULIC POSITIONING OF COMPONENTS

PRIORITY CLAIM

This is a U.S. national stage of application No. PCT/DE2008/000236, filed on Feb. 5, 2008, which claims Priority to the German Application No.: 10 2007 016 045.5, filed: Mar. 30, 2007; the contents of both being incorporated herein by reference.

BACKGROUND OF THE INVENTION

1. Field of the Invention

The invention is directed to a device for hydraulic positioning of structural component parts, in particular rollers of strand guide segments of a continuous casting installation having hydraulic cylinders, each of which is divided into a cylinder space and an annular cylinder space by a piston having a piston rod, the cylinder spaces being connectable to a pressure source by control members.

2. Prior Art

The invention is based on a device such as that known from EP 1 105 235 B1.

In continuous casting installations, the casting process starts in a mold. The superficially solidified strand exits from this mold and is subsequently guided through strand guide segments to a horizontally arranged straightening driver. The strand is guided through guide rollers which are positioned against the strand by hydraulic cylinders.

SUMMARY OF THE INVENTION

It is the object of an invention to achieve at least one of a reduction in hydraulic connection lines and a reduction in components used, e.g., pressure sensors in a device for hydraulic positioning of structural component parts.

In the device mentioned above having hydraulic cylinders, each cylinder is divided into a cylinder space and an annular cylinder space by a piston having a piston rod, wherein the cylinder spaces are connected to a pressure source by control members. According to the invention the annular cylinder space is acted upon by a pressure which is adjustable but which then remains constant while the pressure applied to the piston in the cylinder space is position-controlled or pressure-controlled.

According to a preferable construction, the piston in the annular cylinder space is acted upon by a single-edge-controlled control valve.

A pressure sensor is preferably provided between the control valve and cylinder, or a position transducer is located at the cylinder for position control.

Accordingly, the invention presents a novel concept for hydraulic control of strand guides in continuous casting installations. A single-edge control is used for the positioning or adjustment of force in the strand guide elements (adjustment of the roller gap of strand guide elements for an LCR method, soft reduction, hard reduction, thickness adjustment, or adjustment of a required positioning force) instead of known control valve technique or switching valve technique (both techniques require regulation of both cylinder chamber pressures for adjusting and/or regulating the desired cylinder position or cylinder force).

This novel concept accomplishes a reduction in hydraulic connection lines and hydraulic couplings compared to the known techniques. The use of the indicated single-edge control is correspondingly advantageous especially for controlling segments (usually 4 or more cylinders in one segment). In so doing, the lines (cylinder chambers), which are under the same pressure, are brought together. This concept makes it possible to reduce hydraulic pressure lines, in some cases also the required quantity of hydraulic couplings which is otherwise high. In the event that pressure detection is required for determining or regulating force, the required pressure sensors may also be omitted for the annular cylinder chambers which are brought together at one pressure level. Pressure acquisition need only be carried out once in a combined pressure region.

BRIEF DESCRIPTION OF THE DRAWINGS

The invention will be described in the following with reference to the drawings.

In the drawings.

DETAILED DESCRIPTION OF THE DRAWINGS

Figure 1:
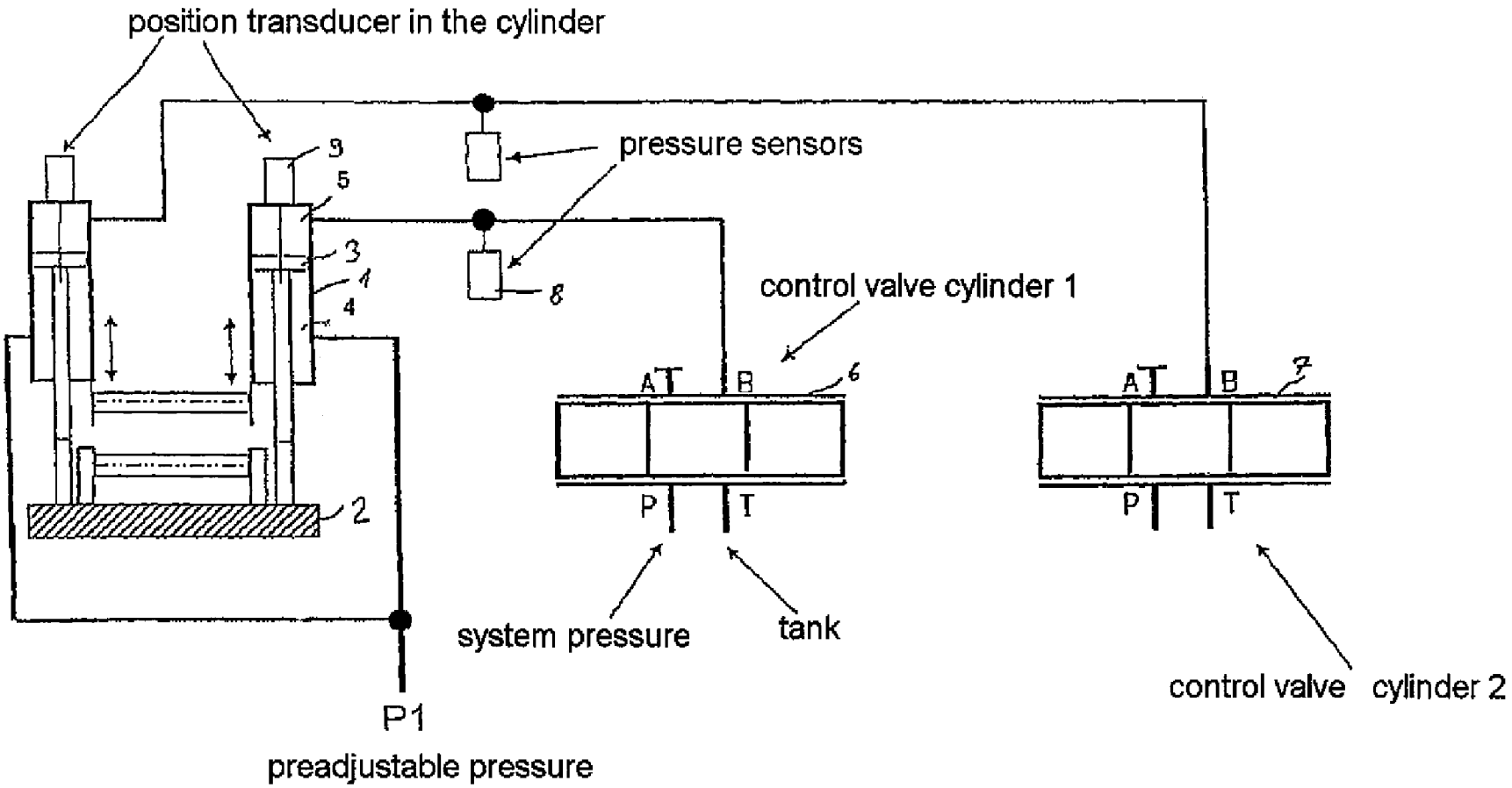
FIG. 1 is an arrangement of valves and cylinders depicted schematically.

Only one guide roller 2 of the strand guide is shown in FIGS. 1-4, this guide roller 2 is acted upon by two hydraulic cylinders 1. Located in each cylinder 1 is a piston 3 which divides the total cylinder space into an annular cylinder space 4 and a cylinder space 5.

Two control valves for the cylinders are designated by 6 and 7. Further, two pressure sensors 8 and position transducers 9 are shown in the general view according to FIG. 1.

As shown in FIG. 1, the cylinder spaces to be regulated, rod side or piston side or, in case of a synchronous cylinder, the rod side used is optionally defined according to the process or safety requirements. A preadjustable, fixed pressure for the annular cylinder space 4 is also defined according to process requirements. When regulating the position of a hydraulic cylinder or when regulating cylinder force, only one pressure is varied by at least one of the control valves 6 or 7. The constant but variably adjustable, pressure acting on the opposite, i.e., complementary, annular cylinder space 4 generates a force required for resetting or changing the actuating direction of the cylinder piston 3. According to the invention, the control valve 6 or 7 which is used is only loaded on one control edge. The second control edge of the control valve is not used.

Figure 2:
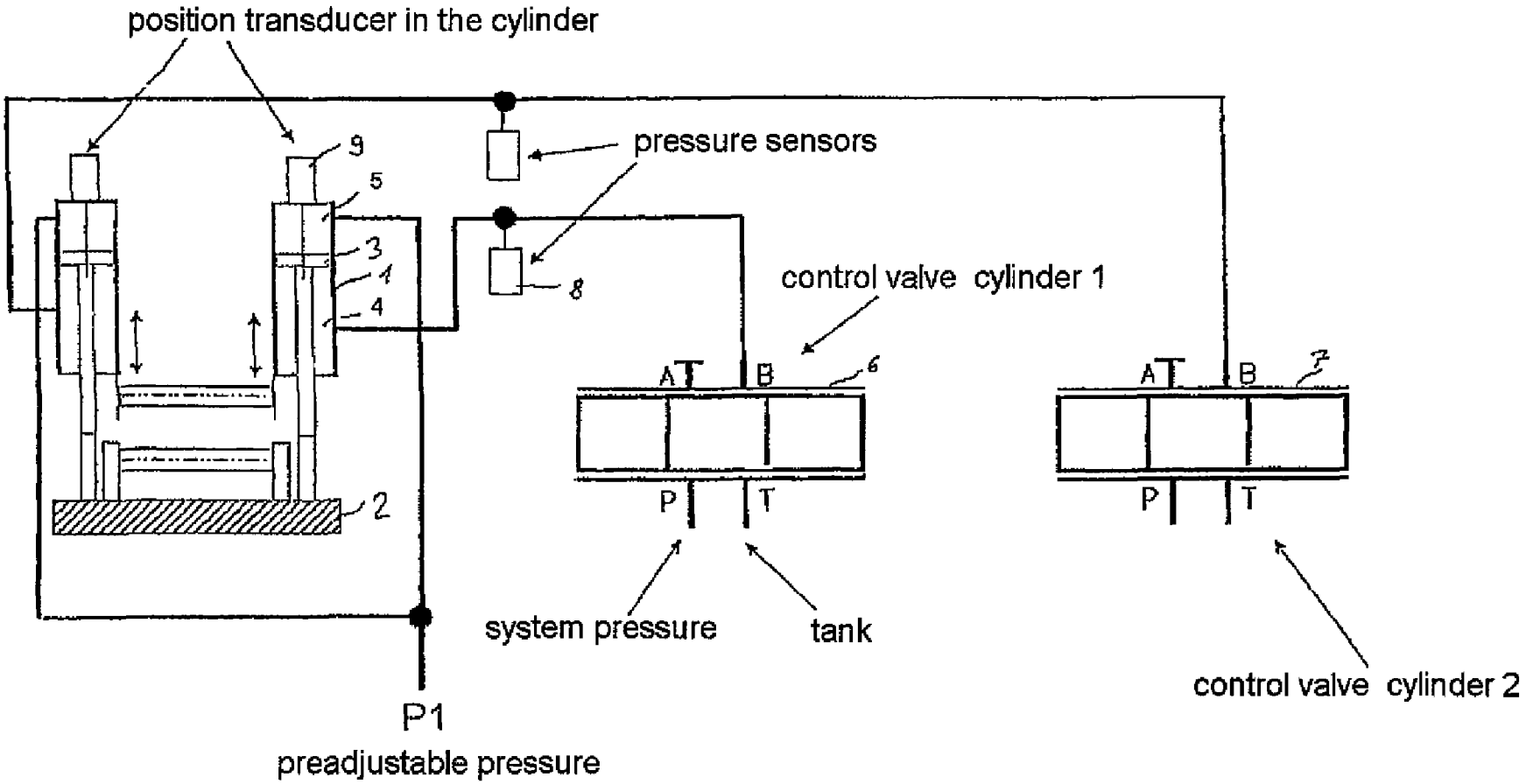
FIG. 2 is regulation of the annular cylinder space depicted schematically.

In contrast to FIG. 1, the annular cylinder space 4 shown in FIG. 2 is acted upon by a pressure that is varied by control valves 6 and 7. In so doing, the pressure sensors 8 are activated. The constant pressure P1 acts on the cylinder spaces 5.

Figure 3:
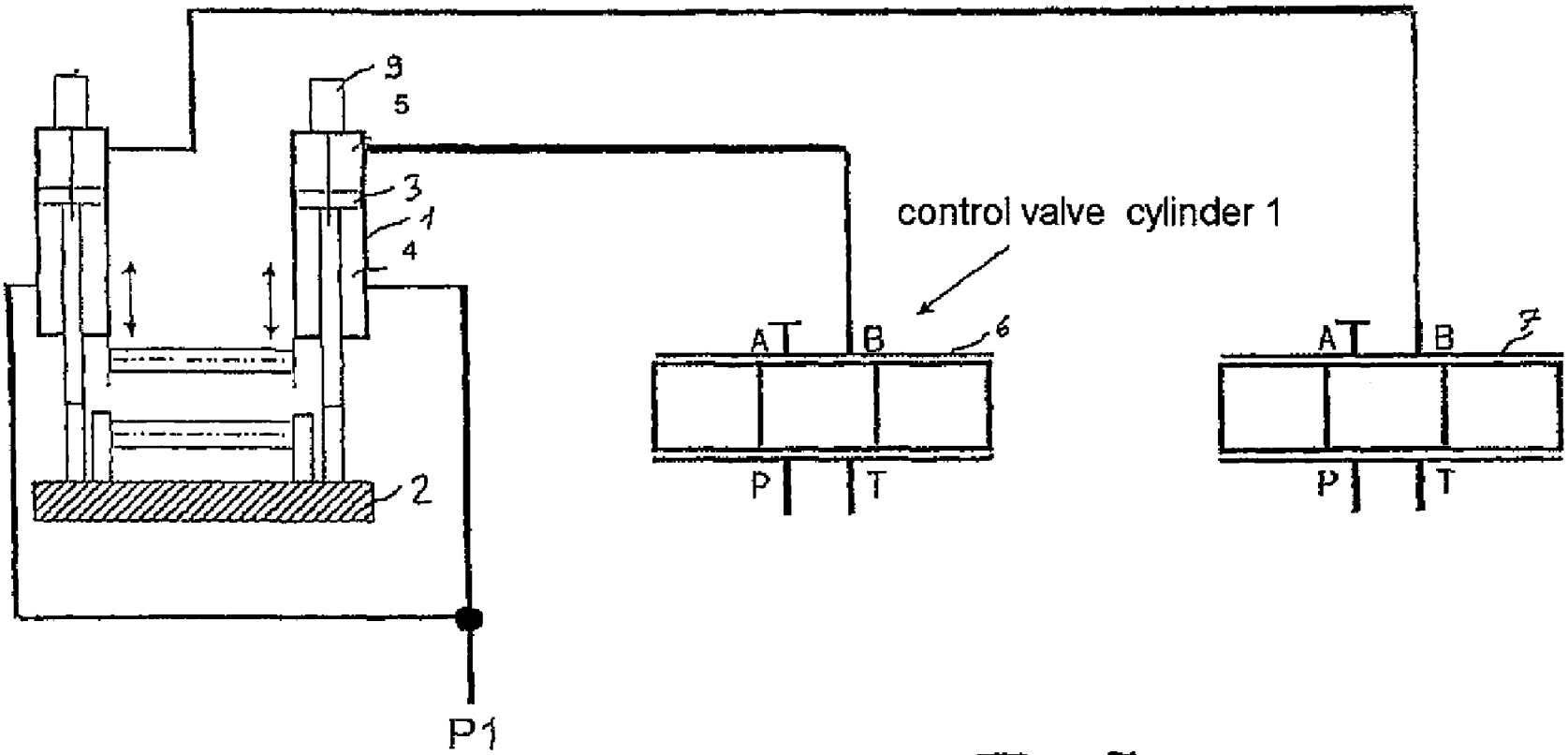
FIG. 3 is position control depicted schematically.

For the position control according to FIG. 3, position transducers 9 are is preferably provided at each of the cylinders 1 and cooperate with the cylinder piston 3. The position transducers 9 are omitted for the pressure control according to FIG. 4, i.e., in the latter case, pressure sensors 8 are used in the lines between the valves and the hydraulic cylinders.

Figure 4:
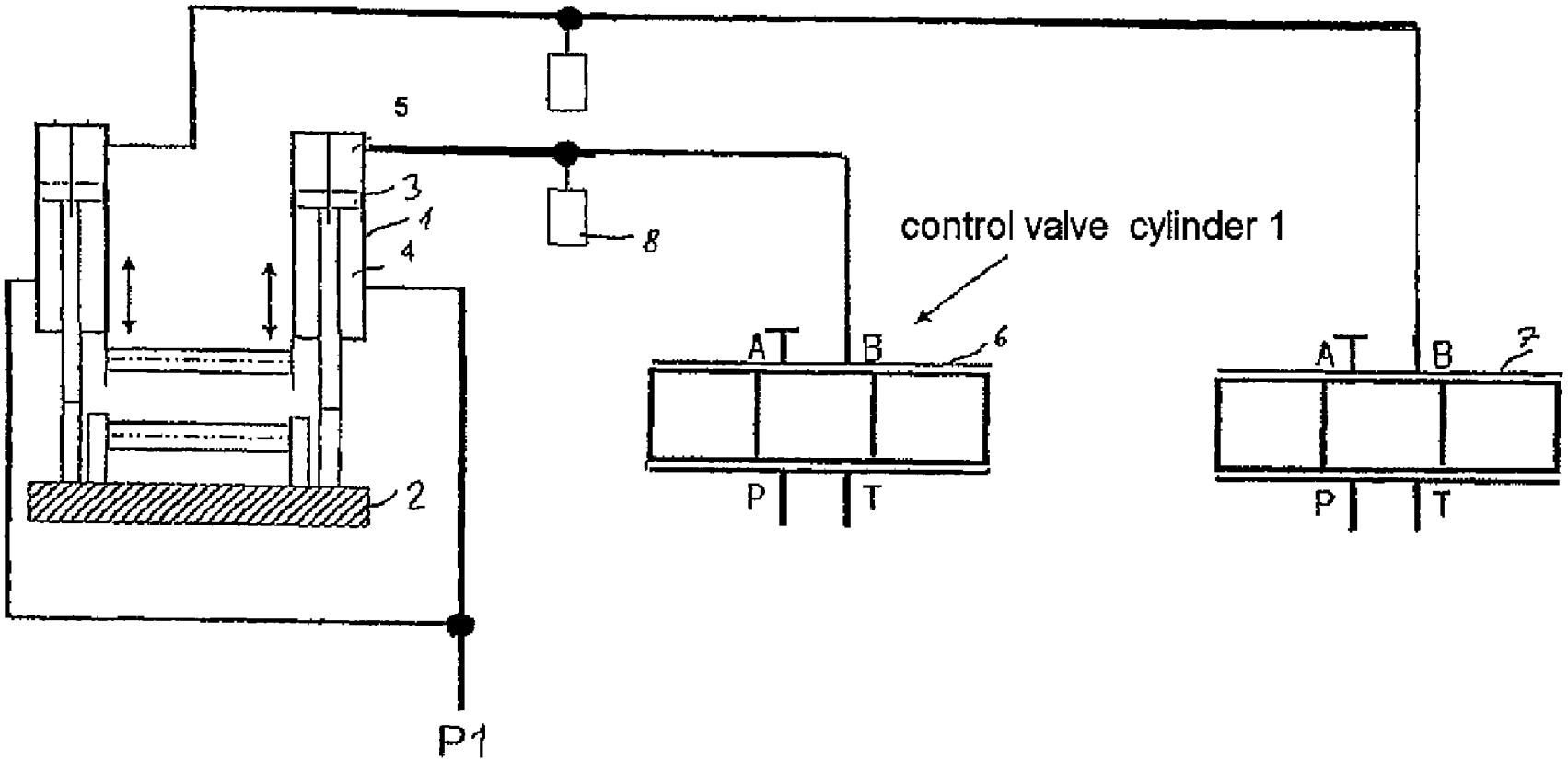
FIG. 4 is pressure control depicted schematically.

The constant pressure acting on the annular cylinder spaces 4 which, however, is adjusted in a defined manner beforehand, is designated by P1 in the constructions according to FIGS. 3 and 4.

To determine the acting force of a cylinder unit, only the controlled cylinder (4 or 5) chamber is outfitted with a pressure sensor 8. The constantly acting second pressure, as preset quantity, is known and used for calculating the resulting total force, preferably taking into account the effective piston surface.

The single-edge controlling of position and/or pressure regulation is be carried out with switching valves according to the embodiment of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A device for hydraulically positioning rollers of strand guide segments of a continuous casting installation, comprising:

at least two hydraulic cylinders for a respective strand guide segment, wherein each hydraulic cylinder comprises:

a cylindrical body;

a piston arranged in the cylindrical body and having a piston rod, the piston configured to divide the cylindrical body into a first cylinder space on a piston rod side of the piston and a second cylinder space on a side of the piston away from the piston rod, the piston being at least one of position-controlled and pressure-controlled;

wherein, one of the first cylinder space and the second cylinder space being acted on by a constant pressure source that provides a constant pressure, wherein the other of the first cylinder space and the second cylinder space is configured to be acted on by a variable pressure source that provides a variable pressure; and a single-edge-controlled control valve acting upon each respective first cylinder space, whereby a number of hydraulic connection lines for the at least two hydraulic cylinders is reduced.

2. The device according to claim 1, further comprising at least one pressure sensor arranged between the control valve and the at least two hydraulic cylinders.

3. The device according to claim 1, further comprising a position transducer arranged in the cylindrical body configured to provide position information related to the piston.

4. The device according to claim 1, wherein the constant pressure is a tank pressure.

5. The device according to claim 1, wherein the variable pressure is a system pressure.

6. The device according to claim 1, wherein the constant pressure is a system pressure.

7. The device according to claim 6, wherein the variable pressure is the system pressure.

8. The device according to claim 7, wherein the system pressure is configured to be adjustable and then remain constant.

9. The device according to claim 1, wherein there are at least four hydraulic cylinders per strand guide segment.

10. A device for hydraulically positioning rollers of strand guide segments of a continuous casting installation, comprising:

at least two hydraulic cylinders per strand guide segment, wherein each of the at least two hydraulic cylinders comprises:

a cylindrical body configured to form an annular cylinder space; and a piston arranged in the annular cylinder space having a piston rod, the piston configured to divide the cylindrical body into a first cylinder space and a second cylinder space, the piston being at least one of position-controlled and pressure-controlled; and at least one single-edge-controlled control valve configured to couple a variable pressure source to one of the first cylinder space and the second cylinder space, the variable pressure source configured to provide an adjustable pressure, wherein the other of the first cylinder space and the second cylinder space is configured to be acted on by a constant pressure source configured to provide a constant pressure, whereby a number of hydraulic connection lines for the at least two hydraulic cylinders is reduced.

11. The device according to claim 10, wherein the adjustable pressure is configured to be adjustable and then remain constant.

12. The device according to claim 10, wherein the pressure is configured to be adjustable and then remain constant.

13. The device according to claim 10, each said at least two hydraulic cylinders further comprising at least one pressure sensor arranged between the control valve and a respective one of at least one of the first cylinder space and the second cylinder space.

14. The device according to claim 10, further comprising a position transducer arranged in the cylindrical body configured to provide position information related to the piston.

15. The device according to claim 10, wherein the constant pressure is a tank pressure.

16. The device according to claim 10, wherein the adjustable pressure is a system pressure.

17. The device according to claim 10, wherein there are at least four hydraulic cylinders per strand guide segment.

* * * * *